United States Patent [19]

Stewart

[11] Patent Number: 4,698,313

[45] Date of Patent: Oct. 6, 1987

[54] METHOD AND DEVICE FOR CONTROLLING A DELAYED COKER SYSTEM

[75] Inventor: William S. Stewart, Bartlesville, Okla.

[73] Assignee: Phillips Petroleum Company, Bartlesville, Okla.

[21] Appl. No.: 827,078

[22] Filed: Feb. 7, 1986

[51] Int. Cl.[4] ..... G01N 37/00

[52] U.S. Cl. ..... 436/55; 422/108; 422/111; 422/109; 208/DIG. 1; 208/131

[58] Field of Search ..... 436/55; 422/105, 108, 422/109, 111, 110, 48; 208/DIG. 1, 131

[56] References Cited

U.S. PATENT DOCUMENTS

| | | | |
|---|---|---|---|
| 2,121,027 | 6/1938 | Forward | 208/31 |
| 2,366,055 | 12/1944 | Rollman | 208/131 |
| 2,882,223 | 4/1959 | Stokes . | |
| 3,759,820 | 9/1973 | Boyd | 436/55 |
| 3,907,664 | 9/1975 | Janssen et al. . | |
| 4,176,052 | 11/1979 | Bruce et al. . | |
| 4,225,559 | 9/1980 | Achari et al. | 436/51 |
| 4,231,753 | 11/1980 | Stewart | 422/109 |
| 4,290,110 | 9/1981 | Makovec | 422/111 |
| 4,332,590 | 6/1982 | Smith | 436/55 |
| 4,400,784 | 8/1983 | Funk et al. | 208/DIG. 1 |
| 4,404,092 | 9/1983 | Audeh et al. . | |
| 4,437,977 | 3/1984 | Funk | 422/105 |
| 4,440,725 | 4/1984 | Swindell et al. | 422/111 |

FOREIGN PATENT DOCUMENTS

| | | | |
|---|---|---|---|
| 0173157 | 12/1985 | European Pat. Off. | 422/94 |

OTHER PUBLICATIONS

Mekler, Brooks *New Developments and Techniques in Delayed Coking*, Lummus Company.

*Primary Examiner*—S. Leon Bashore
*Assistant Examiner*—Lori-Ann Cody
*Attorney, Agent, or Firm*—Laney, Dougherty, Hessin & Beavers

[57] ABSTRACT

A delayed coker control system wherein the hydrocarbon feed flows to the coker furnace is automatically limited to the lowest of the maximum allowable flows to avoid furnace zone flooding, an air-limited furnace and overfilling of the coke drum in the cycle time. Flows among the separate furance zones are adjusted to balance heat loads on each stream and to redistribute excess flow to non-flooding zones.

12 Claims, 4 Drawing Figures

METHOD AND DEVICE FOR CONTROLLING A DELAYED COKER SYSTEM

BACKGROUND OF THE INVENTION

1. Field of the Invention

The present invention relates to coking devices and processes and more particularly to such devices and processes which automatically control the hydrocarbon flow rate and process temperatures therein.

2. Description of Prior Art

In delayed coking processes, heavy petroleum hydrocarbons such as tar, asphalt or the like are circulated through a furnace for heating to coking temperature and then delivered to a coke drum where a coke product forms from the heated heavy hydrocarbons. The overhead of the coke drum is quenched and circulated to a combination tower for separation of the overhead into gas oil, fuel oil, naptha and the like. When the coke drum is filled with coke, a mechanical process of removing the coke from the coke drum is begun. Generally, during the process of removing the coke from the coke drum, the circulation of the heated heavy hydrocarbon is switched to a second coke drum which fills with coke as the first coke drum is being mechanically emptied. The time between switching of the flow between coke drums is the coking cycle time.

One problem with the coking processes presently known is that it is difficult to control the rate of coking to produce a maximum amount of coke in a minimum cycle time. This is because the amount of coke produced by different feeds varies greatly. Also, the hydrocarbon feed has significant differences in its heat transfer characteristics. Fouling of tubing carrying the hydrocarbon feed further changes the heat transfer characteristics. This results in non-uniform heating of the feed material which, in turn, changes the coking characteristics of the feed material. Accordingly, the furnace heating capacity, the coke drum size, and the cycle times are over designed producing inefficiences in each area.

In most coking processes the temperatures, cycle times, feed flow rates and other parameters are manually controlled. The experience of the operator is the only way in which the process is made more efficient. However, an improvement over this manual operation is shown in U.S. Pat. No. 4,176,052. In this process, a radiation source and detector are disposed at a predetermined level of each coke drum and the amount of time to fill the coke drum to this level allows a prediction of a desired rate to fill the remainder of the coke drum. By using this prediction together with the information of feed rate from the last coke cycle, the coking process can be more efficiently operated.

While the prediction of coking based on the previous cycle and a portion of the present cycle improves the control of the coking process, it is still relatively inefficient. Particularly, it does not always produce a maximum coking rate and does not improve the heating inefficiences which are inherent in the present coking processes.

SUMMARY OF THE INVENTION

In accordance with the present invention, a delayed coker system is provided with a process control device for controlling the flow rate of hydrocarbon feed. The system includes a coke drum having a predetermined maximum fill level and means for measuring the time for coke to fill the coke drum to a predetermined volume level. By means of the measurement of the time to fill the coke drum to a predetermined volume level, a prediction of hydrocarbon feed flow rate to fill the coke drum to its predetermined maximum fill level in a predetermined coke drum cycle time is made. The means for measuring the time to fill the coke drum to a predetermined volume level and predicting the first flow rate thus produces a first flow rate signal proportional to the first flow rate.

A combustion furnace having multiple zones is provided for heating the hydrocarbon feed for the coke drum to coking temperature. A separate coil stream of hydrocarbon feed is conveyed through each zone of the multi-zone furnace. Connected to the firing for each zone is a means of determining if the zone is in a flood condition, and if all zones are in a flooded condition producing a second flow rate signal proportional to the flow rate of hydrocarbon feed at which all of said zones are in a flood condition.

An oxygen analyzer is disposed on the combustion furnace for measuring excess oxygen in the combustion furnace. The oxygen analyzer is connected to a means for determining if excess oxygen is below a predetermined level such that the heating ability of the furnace is in an air-limited condition. The air-limited condition produces a third flow rate signal porportional to the rate of hydrocarbon feed to the coke drum corresponding to the air-limited condition.

A process control device for automatically controlling the flow of hydrocarbon feed to the coke drum is connected to the first, second and third signal devices and responsive thereto. The process control device maintains the flow of hydrocarbon feed at the lowest of the first, second and third flow rates in response to the first, second and third flow rate signals. Since the first, second and third flow rate signals are maximum flow rates, the process control device maintains the hydrocarbon feed to the coke drum at a maximum level. This maximum level is limited by the capacity of the coke drum, coil flooding in the furnace, and the heating capacity of the furnace. If desired, a fourth signal to the process control device can be provided which limits the hydrocarbon feed rate to the coke drum at an operator set maximum.

The present invention also balances the heating for each coil stream by providing temperature measuring means for the furnace outlet of each coil stream. A furnace control responsive to the coil temperature signals automatically adjusts the fuel delivered to each zone of the furnace so that each coil stream exits the furnace at a selected temperature. This balances the amount of heating required for each coil stream.

The present invention also provides a furnace coil stream flow control device which distributes the flow of hydrocarbon feed among the coil streams in the furnace. Means are provided for determining if a zone flooding condition is occurring in the heater. If a flooded condition is occurring the operator will reduce hydrocarbon flow to the coils in the flooded zone. The control system will redistribute the flow (removed from the coils in the flooded zone) to coils in zones that are not flooded. If all zones are flooded, the control will reduce the flow of hydrocarbons to the heater. In this manner, the outlet temperature of each coil stream is maintained, the total flow rate of the feed to the coke drum is maintained and the individual flow of feed through each coil stream is controlled to prevent zone flooding in the heater.

Preferably the means for determining whether each zone in the furnace has a flooding condition occurring comprises means for measuring the rate of change of the outlet temperature of each stream and a means for measuring the rate of change of fuel flow to each furnace zone corresponding to each coil stream. These measurements are combined for determining if the ratio of the rate of change of the coil outlet temperature to the corresponding rate of change of fuel flow for each furnace zone is negative. A negative ratio indicates that zone flooding is occurring. As can be seen from the above description, the present invention also provides an improved coking process of the type wherein hydrocarbon feed for a coke drum is separated into multiple furnace coil streams each of which is heated to a coking temperature in a separate zone of the multi-zoned furnace. The improvement comprises determining if each zone is in a flooding condition and for each coil stream located in a zone in which flooding is occurring, reducing the flow in that stream and automatically distributing the amount of flow so reduced among the other coil streams located in zones in which flooding is not occurring so that the total rate of feed flow through all the coil streams in the furnace is maintained.

The present invention also provides a method of controlling flow of hydrocarbon feed to a coke drum so as to optimize flow. First, second and third hydrocarbon feed flow rates are determined for the coke drum. These flow rates are maximum flow rates limited by the capacity of the coke drum, zone flooding in the combustion furnace and the combustion furnace heating capacity being air-limited. The flow of hydrocarbon feed is automatically limited to the lowest of these maximum flow rates.

For a further understanding of the invention and further objects, features, and advantages, reference may now be had to the following description taken in conjunction with the accompanying drawings.

BRIEF DESCRIPTION OF THE DRAWINGS

FIG. 3 is a schematic view of a portion of the process control utilized in connection with the coking process shown in FIG. 1.

DETAILED DESCRIPTION OF PREFERRED EMBODIMENT OF THE INVENTION

Figure 1:
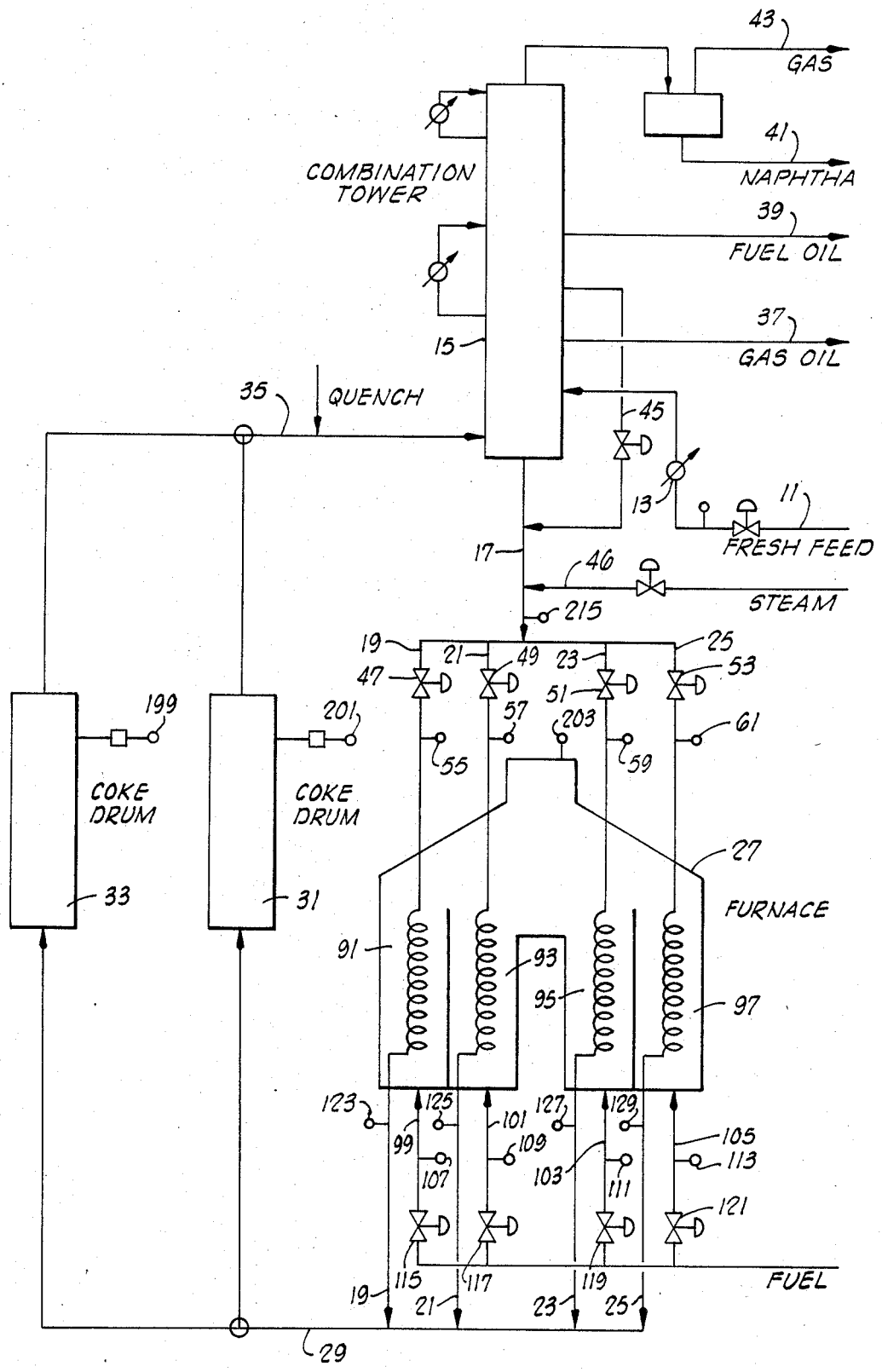
FIG. 1 is a schematic view of a delayed coking process in accordance with the present invention.

Referring initially to FIG. 1, a fresh feed stream 11 of a hydrocarbon coking material such as asphalt or the like is heated in a heat exchanger 13 and introduced into the bottom of the combination tower 15. The bottoms from the combination tower 15 forms a stream 17 which is divided into coil streams 19, 21, 23 and 25. The coil streams 19–25 each are conveyed through a separate zone of a multi-zoned furnace 27 for heating the hydrocarbon feed to a coking temperature. After the coil streams 19–25 exit the furnace 27, they recombine into a coke drum feed stream 29. The coke drum feed stream 29 alternately feeds coke drum 31 and coke drum 33 as these coke drums cycle between coking and removal of the coke from the drum. During coking, the overhead vapor stream 35 from the coke drum 31 or 33 is quenched and returned to the bottom of the combination tower 15. The combination tower then fractionates these vapors into a gas oil stream 37, a fuel oil stream 39, a naptha stream 41 and a gas stream 43. A recycle stream 45 circulates a portion of the tower fractions between the fuel oil and gas oil fractions to the bottoms stream 17 to provide a flow rate through the furnace 27 which is sufficiently high so as to avoid stagnant liquid in the coil streams. Thus, the total hydrocarbon feed to the furnace 27 includes reflux from the tower 15, fresh feed 11 and recycle 45.

If the hydrocarbon feed is not sufficiently high, steam in a stream 46 can be added to the stream 17 to the furnace 27. Many processes utilize a constant flow of steam to protect the coil streams in the furnace.

The above description of the flows to coke drums 31 and 33 for the coking process are conventional. A typical feed rate for the fresh feed stream 11 would be approximately 960 barrels per hour and would enter the combination tower at approximately 670° F. The bottoms stream from the tower 15 has a temperature of approximately 675° F. and the coke drum feed stream 29 has a temperature of approximately 920° F. Following quenching the overhead vapors from the coke drum 31 or 33 have a temperature of approximately 810° F. Gas oil would typically be produced at 270 barrels per hour, fuel oil at 290 barrels per hour and naptha at 160 barrels per hour. The recycle stream 45 would typically have a flow rate of approximately 140 barrels per hour.

The flow in the furnace coil streams 19, 21, 23 and 25 are controlled by valve 47, 49, 51 and 53, respectively. The flow rate in coil streams 19, 21, 23 and 25 is monitored by flow meters 55, 57, 59 and 61, respectively. Each of the flow meters 55–61 and there respective flow control valves 47–53 are operated together by feed flow controllers for each coil stream 19–25. In other words, each of the valves 47–53 is automatically controlled and the flow rate in each of the streams 19–25 automatically monitored by the meters 55–61 so that the flow rate in each of the streams 19–25 can be determined and controlled. Equipment for receiving signals from the meters 55–61 and controlling the valves 47–53 so as to control the flow rates in streams 19–25 are well within the skill of those in process control art.

Figure 2:
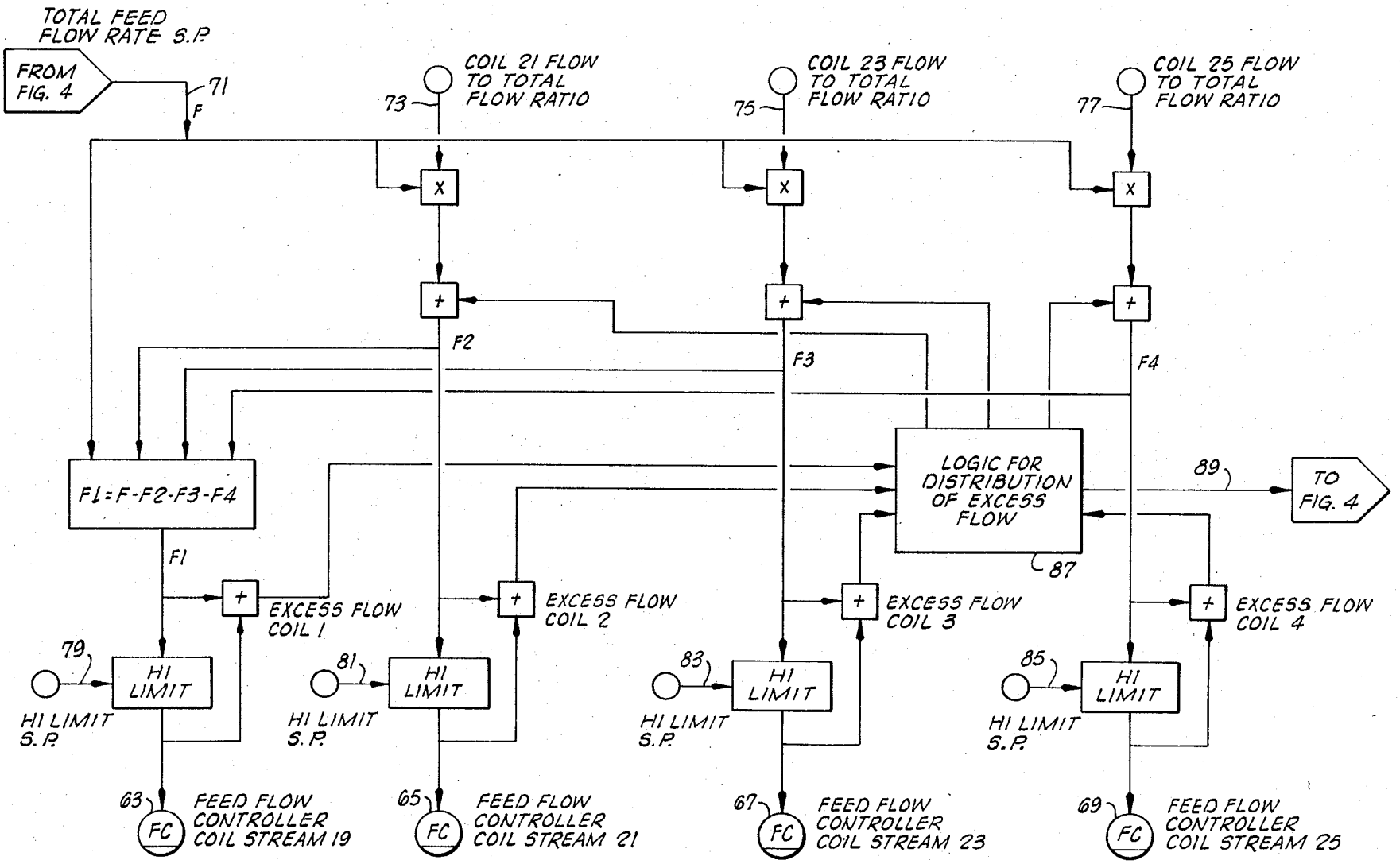
FIG. 2 is a schematic view of the process control utilized with the coking process shown in FIG. 1.
Figure 5:
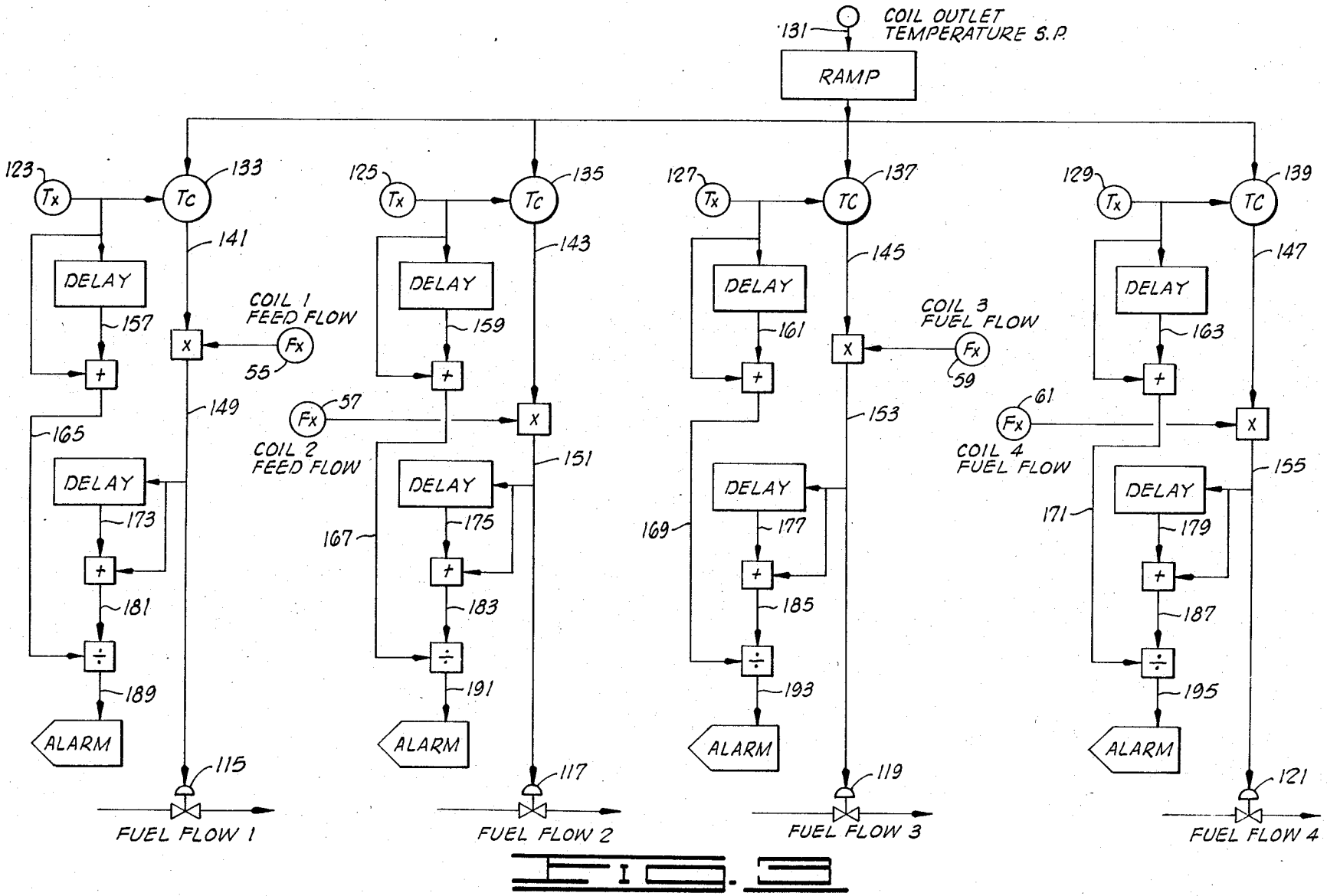

Referring now to FIG. 2, a flow diagram for the control of the flow in coil streams 19–25 is illustrated. Feed flow controllers 63, 65, 67 and 69 are connected for operation of and actuation of valves 47, 49, 51 and 53, respectively. Flow meters 55–61 are also connected to the feed flow controller 63–69, respectively, so that signals from the feed flow controllers 63–69 actuate the valves 47–53 to produce the desired flow rates as indicated by the meters 55–61.

To provide automatic operation of the feed flow controllers 63–69, three types of signals are provided. The first signal is a total feed flow rate signal derived from the process control shown in FIG. 4 and described in more detail below is used. The second type of signal used is a individual coil flow to total flow ratio signal. These signals are manually entered by an operator and are proportional to the fraction of the total feed flow carried by each coil stream. A ratio signal 73 corresponds to the desired flow ratio for coil stream 21, a ratio signal 75 corresponds to a desired flow ratio for coil stream 23 and a signal 77 corresponds to a desired flow ratio for coil stream 25. No ratio signal needs to be separately set for the coil stream 19 since the flow for coil stream 19 is the difference between the total flow rate signal 71 and the sum of the flow rate signals 73, 75 and 77. For example, the flow rate signal ratio 73–77 could each initially be set at 0.25. Such a setting would correspond to each of the coil streams 19–25 carrying one-fourth of the total flow of hydrocarbon feed through the furnace 27.

The third type of signal used by the feed flow controllers 63–69 are high limit set point signals 79, 81, 83 and 85 corresponding to the maximum amount of flow allowed in each of the streams 19, 21, 23 and 25, respectively. These signals can be manually set by an operator or automatically generated in response to zone flooding. If automatically set in response to zone flooding, the signal 79–85 would correspond to the highest coil feed rate possible for that particular zone which does not cause zone flooding. The logic for utilizing the three types of signals by the feed flow controller 63–69 is shown in FIG. 2. The coil flow to total flow ratio signals 73–77 are multiplied by the total feed flow rate signal 71 to indicate a desired flow rate for each of the coil streams 21–25. The feed flow rate for coil stream 19 is obtained by subtracting the feed flow rates for coil streams 21–25 from the total flow rate signal 71. Each of these flow rate signals are compared to the respective high limit signals 79–85 to arrive at a signal to the feed flow controllers 63–69. In other words, if the high limit signal is lower than the desired flow rate signals based on the total flow signal 71 and the ratio signals 73–77, the high limit signals are send to the feed flow controllers as opposed to the calculated flow signals. If none of the high limit signals 79–85 are exceeded, the calculated flow signals are conveyed to the feed flow controllers 63–69. The feed flow controllers 63–69, in turn, adjust the flow streams 19–25 by means of the valves 47–53 and the meters 55–61.

If any of the high limit signals 79–85 are exceeded, the excess flow (the difference between the calculated flow and the high limit signal which is actually conveyed to the feed flow controller) is calculated and the excess flow signal is conveyed to a logic unit 87. The logic unit 87 divides the excess flow among the streams which do not have excess flow and generates a signal for adding to the non-limiting feed flow signals. For example, if the calculated feed flow for stream 19 exceeded the high limit set by high limit signal 79 an excess flow signal would be generated for coil stream 19. The logic unit 87 would divide the excess flow by three and distribute it one-third to the calculated flow for stream 21, the calculated flow for stream 23 and the calculated flow for stream 25.

By distributing the excess flow from each of the streams among the other streams, the total feed rate as indicated by signal 71 is maintained. This allows a maximum flow through the furnace 27. If all of the streams 19–25 have excess flow signals being sent to the logic unit 87, a signal 89 is generated by the logic unit 87. This signal 89 is the sum of the high limit signals 79–85; i.e. the total flow which will not produce an excess flow in any of the coil streams. When the high limit signals 79–85 are set in accordance with zone flooding, the signal 89 corresponds to the maximum amount of flow through the furnace 27 which will not produce zone flooding.

Referring now to FIG. 3 as well as FIG. 1, the process of the present invention for controlling the temperature of coil streams 19–25 is indicated schematically. Each of the coil streams 19, 21, 23 and 25 is conveyed through a separate zone of the furnace 27. Coil stream 19 is conveyed through zone 91, coil stream 21 is conveyed through zone 93, coil stream 23 is conveyed through zone 95 and coil stream 25 is conveyed through zone 97. A separate burner is provided for each of the zones 91–97 and a separate fuel stream conveys fuel to each of these separate burners. Fuel stream 99 conveys fuel to the burner 91, fuel stream 101 supplies fuel to the burner to the zone in 93, fuel stream 103 supplies fuel to the burner to the zone in 95 and fuel stream 105 provides fuel to the burner to the zone in 97. For determining the flow in each of the streams 99–105, flow meters 107, 109, 111 and 113 are provided. Connected to control flow through streams 101–105 are valves 115, 117, 119 and 121.

Connected to the coil streams 19–25 as the coil streams exit the furnace 27 are coil outlet temperature meters 123, 125, 127 and 129. The meters 123–129 measure the temperatures of the coil streams as they leave the furnace 27 and generate a signal proportional thereto. These coil outlet temperature signals together with flow signals from meters 55–61 and a manually set desired coil outlet temperature signal 131 are used to control the fuel flow to each of the furnace zones and, thereby, the coil outlet temperature for each coil stream. The means for attaining this process control is shown in FIG. 3.

As shown in FIG. 3, the desired coil outlet temperature signal 131 is ramped so that changes in the desired coil outlet temperature setting are conveyed progressively to the system as opposed to abruptly. For example, a 5° change in coil outlet temperature might be conveyed at the rate of 1° every five minutes. The desired coil outlet temperature signal 131, after being ramped, is communicated to temperature controllers 133, 135, 137 and 139. These temperatures controllers are connected to receive the coil outlet temperature from the coil outlet meters 123–129. They compare the actual coil outlet temperatures to the desired coil outlet temperature and produce signals 141–147 which are proportional to the difference in these temperatures and weighted according to the changes in fuel flow per unit of feed flow required to achieve a temperature change in the coil outlet stream. These signals are then multiplied by the feed flow signals from meters 55–61 to result in fuel flow signals 149–155. These fuel flow signals are conveyed to the valves 115–121, respectively, to adjust the fuel flow in the streams 99–105 to a flow necessary to change the actual coil outlet temperatures to the desired coil outlet temperatures. Of course, meters 107–113 cooperate with the signals 149–155 and the valves 115–121 to achieve the desired fuel flow.

As described above, the present invention automatically adjusts the fuel flow in the streams 99–105 to achieve a desired coil outlet temperature in each of the coil streams 19–25. This automatic adjustment insures that heating of the coil streams is efficient and that the charge to the coke drum will have a more uniform coking characteristics. It automatically adjusts for fouling of the coil tubing and for drafts and furnace characteristics. Moreover, the signals utilized in the automatic adjustment of the fuel flow can be used to determine whether zone flooding is occurring.

Zone flooding occurs in zones 91–97 whenever an increase in fuel flow to a zone results in a decrease in the corresponding coil outlet temperature. Zone flooding is a condition in which part of the fuel combustion is taking place in the convection section or stack of the heater rather than in the radient or zone section of the heater. It is, therefore, desirable to automatically determine if zone flooding is occurring so that the feed rate in the coil streams 19–25 can be reduced until zone flooding is not occurring. The process to determine zone flooding is shown in FIG. 3. The coil outlet temperature signal from the temperature meters 123–129 are processed to produce a delayed signal 157–163. The difference between the coil outlet temperatures without delay and with delay results in signals 165–171 which are an indication of or are proportional to the rate of change of coil outlet temperature for each of the coil streams. Similarly, the fuel flow signals 149–155 are processed to produce a delayed signals 173–179 and the delayed signals are compared with the undelayed fuel flow signals to result in signals 181, 183, 185 and 187. The signals 181–187 indicate or are proportional to the rate of change in fuel flow in streams 99–105.

Signals 165–171 are divided by the signals 181–187 to result in ratio signals 189, 191, 193 and 195. These ratio signals indicate or are proportional to the ratio of the rate of change of the coil outlet temperature to the rate of change of fuel flow to the furnace zone corresponding to that coil stream. If the ratio signals 189–195 are negative, this indicates a zone flooding condition and an alarm signal is generated. If the ratio signals 189–195 are not negative, zone flooding is not occurring and no alarm is generated.

When an alarm signal is generated, an operator can determine thereby that zone flooding is occurring and in which zone it is occurring. Further, by noting the flow rate in the coil stream of the zone in which flooding is occurring, the operator can adjust the coil flow ratio signals 73–77 or the high limit signals 79–85 so that zone flooding is not occurring. If desired, these changes can be made automatically in response to the zone flooding signal. For example, the alarm signal could generate a new high limit signal corresponding to the feed flow in the coil stream of the zone in which the flooding occurs. Similarly, the alarm signal could generate an adjustment to the coil flow ratio signals so that the amount of flow causing the zone flooding can be automatically distributed by the process control depicted in FIG. 2 to the other coils in non-flooded zones.

By predicting and compensating coil flows for flooded zones, the coil outlet temperatures can be maintained at the desired coil outlet temperatures when it would otherwise not be possible. Thus, when changes to the fuel flow to the furnace cannot achieve the desired coil outlet temperature, the flow rates in the coil streams can be adjusted so that the desired coil outlet temperature can be achieved. Thus, it is particularly desirable to combine the automatic adjustment of the fuel flow to achieve a desired coil outlet temperature with a zone flooding control which adjusts the coil stream flow to achieve the desired coil outlet temperatures. It is even more desirable to achieve this desired coil outlet temperature uniformity together with a maximum flow rate through the furnace in all of the coil streams.

Figure 4:
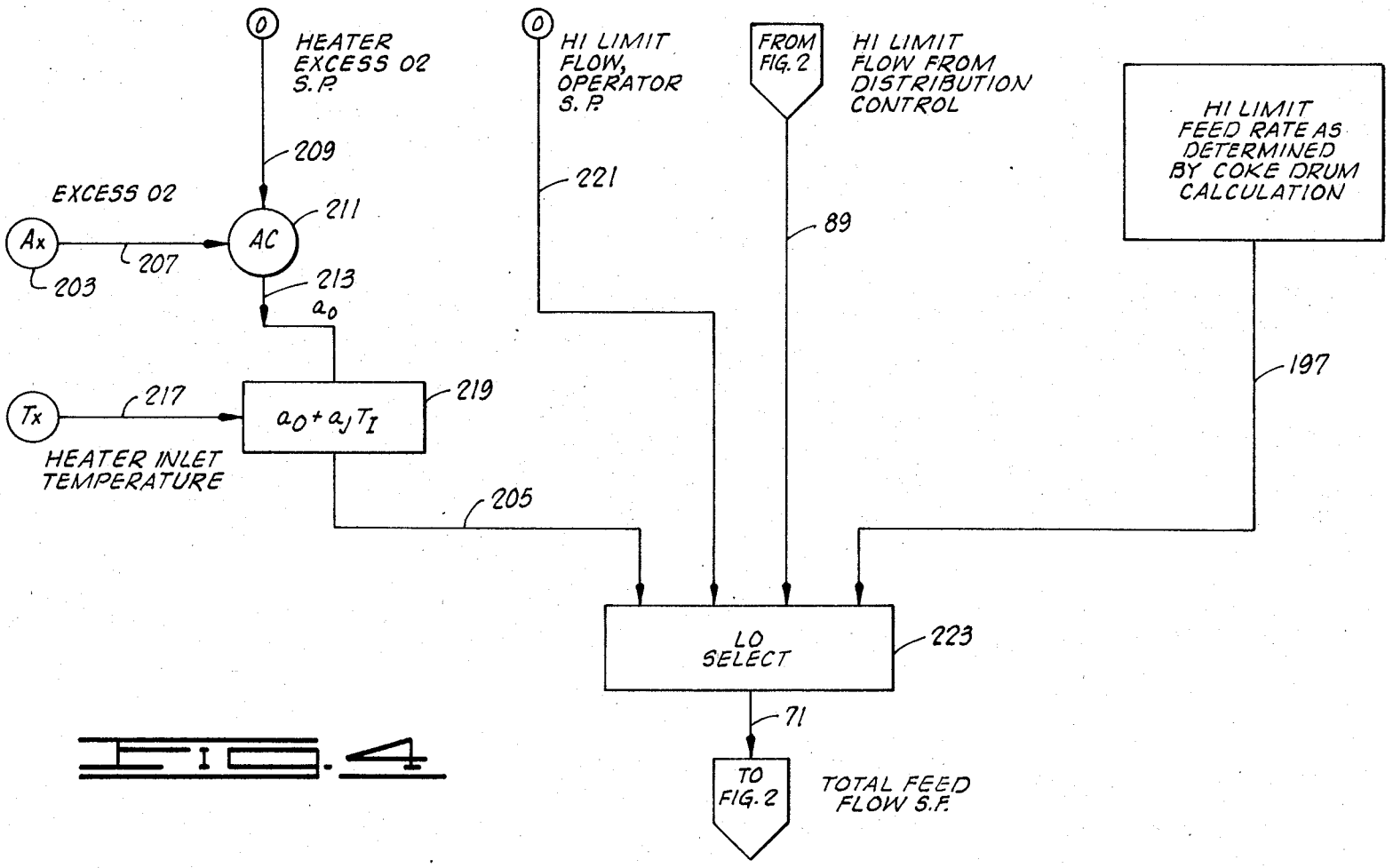
FIG. 4 is a schematic view of a portion of the process control utilized in connection with the coking process shown in FIG. 1.

The method of determining a maximum flow rate through the furnace 27 and the charge rate to the coke drums 31 and 33 is schematically depicted in FIG. 4. First, as generally described in U.S. Pat. No. 4,176,052, a maximum charge rate to the signal 197 can be predicted by means of coke drum volume measuring devices 99 and 201 and a coke drum calculation. First, a determination is made when the coke drum begins to fill so that the time interval between this beginning and the coke drum level indicated by the level devices 199 and 201 can be determined. The coke drum level devices 199 and 201 are disposed at predetermined volume levels of the coke drum so that the accumulated charge rate, time interval and coke volume can be used to predict a maximum charge rate which will fill the coke drum to a maximum fill level in the remaining cycle time. Thus, the coke drum calculation is; $C=V1/F_p$ where C is the coking rate, V1 is the volume of the coke drum to the predetermined level and $F_p$ equals the accumulated feed flow at the time the predetermined level is reached (obtained by integrating the feed flow rates in all of the charge streams with time). The feed rate which will fill the coke drum to its maximum level can be determined by the formula $F_r=R\times t-T1$, where $F_r$ equals the maximum feed rate, R equals the remaining capacity of the coke drum above the predetermined levels, the end of the outage time is t, and the time at which the predetermined level occurs in the cycle is T1.

The predetermined level coke drum meters 199 and 201 are preferably gamma gauges attached to the coke drums. Such gauges are well-known in the art. The gauges are connected to a processor to calculate a maximum feed rate signal 197 as described above. The feed flow meters 55–61 on coil streams 19–25 can be connected to the processor to integrate the total feed volume when the predetermined level is attained.

A second maximum feed rate or charge rate to the coke drum 31 and 33 is obtained by the logic unit 87 used to distribute the excess flow and the control of flow in the coil streams 19–25. Thus, signal 89 represents a maximum feed flow which results in excess flow in all of the coil streams 19–25.

A third maximum flow signal is generated in accordance with the present invention based on a calculation of excess oxygen in the furnace 27. An excess oxygen analyzer 203 is disposed on the flue of furnace 27 to gauge the amount of oxygen in the flue gases. When the amount of oxygen drops to a predetermined level, additional fuel flow to the furnace does not result in additional heating. In other words, when the excess oxygen drops below this predetermined level the furnace is air-limited.

The logic for creating a maximum flow signal 205 which corresponds to the flow which creates an air-limited condition in the furnace 27 is shown in FIG. 4. The signal 207 from the excess oxygen analyzer 203 is compared with a signal 209 which corresponds with the predetermined level of excess oxygen indicating an air-limited condition. If the signal 207 is less than the signal 209 an air controller 211 generates a signal 213 which is proportional to the flow rate in streams 19–25 giving rise to the air-limited condition.

It is desirable to further process the signal 213 so that a sudden temperature drop in the bottoms stream 17 will automatically reduce the maximum flow signal 213 generated in an air-limited condition. A temperature gauge or meter 215 is, therefore, connected to generate a signal 217 corresponding to the temperature in bottoms stream 17 (the inlet temperature to the furnace 27). This signal is then processed by a logic unit 219 which sums the feed flow signal with the inlet temperature multiplied by a desired feed flow factor to result in a maximum feed flow signal 205.

A fourth maximum feed flow signal 221 can be set by the operator for manual control of the process when maximum flows through the furnace and coke drum are not desired. This signal can also be used to prevent flow higher than a predetermined level so that transient maximum flows do not occur.

The maximum flow signals 197, 89, 221 and 205 are processed so that the least of these maximum flows is chosen in a logic unit 223. The least of the maximum flows is then transmitted as a signal 71 which is the maximum flow signal utilized in the flow distribution process schematically shown in FIG. 2. In this manner the charge flow through the furnace and to the coke drums can be maintained at a maximum level which is limited by the coke drum calculation, zone flooding, an air-limited condition in the furnace and an operator set limit.

The process control described above can be achieved using analog or digital processors which are well-known in the art. It is believed that the most preferable processing equipment is digital equipment with a microprocessor logic control processing. This equipment and the meters and valves utilized in connection with the present invention are well-known to those skilled in the art.

Various pumps, valves and similar devices which are not critical to the process or device of the present invention, have not been depicted in the schematic views of the present invention. Control of the combination tower 15, the cycles of the coke drums 31 and 33 are conventional.

If desired, the control system of the present invention can also be used to maximize flow in feed stream 11. This can be achieved by calculating the tower reflux in tower 15 combined with the recycle flow 45. By maintaining this combined flow at a minimum (controlling the recycle flow 45 responsive to changes in the tower reflux), the fresh feed flow 11 can be maintained at a maximum. Thus, fresh feed can be maximized in addition to maximizing flow 17 to the furnace 27 as described above.

Because the control system of the present invention constantly monitors the total flow in each coil stream in the furnace 27, steam flow to the coils necessary to maintain a minimum coil velocity can be minimized. This maximizes the amount of hydrocarbons in the coil streams when steam must be used. If the hydrocarbon flow falls below a predetermined minimum, as for example, occurs when a valve should fail, steam flow could be set to a predetermined flow rate to protect the coil. If desired, a protective control can be added to prevent coil burning by steam flooding when the feed rate falls below a predetermined low level.

As can be seen by the above description, the methods and apparatus of the present invention are well adapted to achieve the objects and advantages mentioned as well as those inherent therein. While presently preferred embodiments of the present invention have been described for the purpose of this disclosure, numerous changes in the construction and arrangement of parts and the method can be made by those skilled in the art, which changes are encompassed in the spirit of this invention as defined by the appended claims.

What is claimed is:

1. A method of controlling a coking process wherein a hydrocarbon feed for a coke drum is separated into multiple furnace coil streams each of which is heated to a coking temperature in a separate zone of a multizone furnace; comprising the steps of:

determining for each said zones if zone flooding is occurring; and for each coil stream in a zone in which zone flooding is occurring, reducing the rate of flow in that stream so that zone flooding is not occurring and automatically distributing the amount of flow so reduced among coil streams located in zones that are not flooding so that the total rate of feed flow through all coil streams in the furnace is maintained.

2. The method of claim 1 wherein said zone flooding determining step comprises:

measuring the rate of change of the coil outlet temperature of each coil stream;

measuring the rate of change of fuel flow to each furnace zone corresponding to each coil stream; and determining if the ratio of said rate of change of the coil outlet temperature to said corresponding rate of change of fuel flow for each furnace zone is negative.

3. A method of controlling flow of hydrocarbon feed to a coke drum so as to optimize flow in a delayed coking process wherein the hydrocarbon feed is heated to coking temperature in a coil stream combustion furnace and combustion is controlled so as to produce a desired coking temperature, comprising:

(a) determining a first flow rate of hydrocarbon feed to said coke drum which will fill the coke drum to capacity in a cycle time;

(b) determining if flow of the hydrocarbon feed is causing a zone flooding condition in said combustion furnace and upon a zone flooding condition determining a second flow rate of hydrocarbon feed to said coke drum corresponding to this zone flooding condition;

(c) determining if the combustion furnace is in an air-limited condition and upon an air-limited condition determining a third flow rate of hydrocarbon feed to said coke drum corresponding to this air-limited condition; and (d) automatically controlling the flow of hydrocarbon feed into said coke drum to flow at a feed rate which is not higher than the highest of said first, second and third flow rates.

4. The method of claim 3 wherein said hydrocarbon feed is separated into multiple furnace coil streams each of which is heated to a coking temperature in a separate zone of said coil stream combustion furnace, and which further comprises the steps of:

determining for each of said zones if zone flooding is occurring; and for each coil stream in a zone in which zone flooding is occurring, reducing the rate of flow in that stream so that zone flooding is not occurring and automatically distributing the amount of flow so reduced among coil streams in zones in which zone flooding is not occurring so that the total rate of feed flow through all coil streams in the furnace is maintained.

5. The method of claim 3 wherein said zone flooding condition comprises zone flooding occurring in all of said zones.

6. The method of claim 5 which further comprises the steps of:

determining the temperature of the hydrocarbon feed to said combustion furnace;

determining if said combustion furnace is in an air-limited condition; and when said air-limited condition is occurring, automatically reducing said third flow rate determined thereby proportionally with temperature reductions of said feed to said combustion furnace.

7. The method of claim 6 wherein hydrocarbon feed to said coke drums consists of a fractionator tower reflux, a fractionator tower recycle, and fresh feed and which further comprises the steps of:

determining the combined flow rate of said fractionator tower reflux and said fractionator tower recycle; and automatically maintaining said combined flow rate at a predetermined minimum flow rate by controlling flow in said recycle responsive to said determining step and thereby maintaining said fresh feed flow at a maximum flow rate.

8. The method of claim 7 wherein steam is added to said hydrocarbon feed to said combustion furnace and which further comprises:

automatically controlling said flow of steam responsive to said step of automatic control of hydrocarbon feed so as to maintain said flow of steam at the minimum flow required to maintain a predetermined minimum flow rate of hydrocarbon feed and steam in said furnace.

9. A delayed coker system with a process control device for controlling the flow rate of hydrocarbon feed, comprising:

a coke drum to which a hydrocarbon feed is delivered at coking temperature and in which a coke product is formed, said coke drum having a predetermined maximum fill level;

first signal producing means connected to said coke drum for measuring the time for coke to fill said coke drum to a predetermined volume level and predicting thereby a first flow rate which will fill the coke drum to the predetermined maximum fill level in a predetermined coke drum cycle time, and producing a first flow rate signal proportional to said first flow rate;

a combustion furnace having multiple zones through each zone of which is conveyed a separate coil stream of hydrocarbon feed for heating of said stream to coking temperature, said furnace being connected to convey said hydrocarbon feed streams to said coke drum;

second signal producing means for determining if all of said zones are in a zone flooding condition and producing a second flow rate signal proportional to a second flow rate of hydrocarbon feed at which all of said zones are flooding;

an oxygen analyzer disposed on said combustion furnace for measuring excess oxygen in said combustion furnace;

third signal producing means connected to said oxygen analyzer for determining if excess oxygen in said combustion furnace is below a predetermined level such that the heating ability of said furnace is in an air-limited condition and for producing a third flow rate signal proportional to a third flow rate of hydrocarbon feed to said coke drum corresponding to this the air limited condition; and a coke feed control means connected to said first, second and third signal producing means for automatically controlling the flow of said hydrocarbon feed to said coke drum responsive to said first, second and third flow rate signals such that the flow of said hydrocarbon feed is maintained at the lowest of said first, second and third flow rates.

10. The system of claim 9 which further comprises:

furnace outlet temperature measuring means connected to said combustion furnace for measuring the temperature of hydrocarbon feed in each coil stream as it exits the furnace and for producing signals proportional to each such temperature measured; and furnace combustion fuel control means connected to said furnace outlet temperature measuring means and to said combustion furnace for delivering combustion fuel to each furnace zone responsive to said fuel outlet temperature measuring means signals such that the fuel delivery is automatically adjusted for each zone until the temperature of the hydrocarbon feed in each coil stream as it exits the furnace is a selected temperature.

11. The system of claim 10 which further comprises:

means for determining if a zone flooding condition is occurring in said furnace zones connected to said furnace outlet temperature measuring means and to said furnace combustion fuel control means; and furnace coil stream flow control means connected to said means for determining if a zone flooding condition is occurring in said combustion furnace for reducing flow to streams in flooded zones, the flow of hydrocarbon feed in each coil stream in said furnace and for distributing the flow among the coil streams so that the total rate of feed flow through all coil streams in the furnace is maintained responsive to said means for automatically controlling the flow of said hydrocarbon feed to said coke drum.

12. The system of claim 11 wherein said means for determining for each zone flooding is occurring comprises:

temperature rate change means for measuring the rate of change of the coil outlet temperature of each coil stream connected to said furnace outlet temperature measuring means;

fuel flow rate change means for measuring the rate of change of fuel flow to each furnace zone corresponding to each coil stream connected to said furnace combustion fuel control means; and means for determining if the ratio of said rate of change of the coil outlet temperature to said corresponding rate of change of fuel flow for each furnace zone is negative.

* * * * *